United States Patent [19]

Hunsicker

[11] 4,113,170

[45] Sep. 12, 1978

[54] RURAL MAILBOX DELIVERY SIGNAL

[76] Inventor: Monroe T. Hunsicker, Rte. 1, Earlsboro, Okla. 74840

[21] Appl. No.: 819,013

[22] Filed: Jul. 25, 1977

[51] Int. Cl.[2] ..... A47G 29/12

[52] U.S. Cl. ..... 232/35; 232/36

[58] Field of Search ..... 232/34, 35, 17, 36; 297/333; 248/382

[56] References Cited

U.S. PATENT DOCUMENTS

| | | | |
|---|---|---|---|
| 2,253,461 | 8/1941 | Hoppe | 232/34 |
| 2,551,915 | 5/1951 | Turner | 232/34 |
| 2,693,314 | 11/1954 | Hunter | 232/35 |
| 3,572,581 | 3/1971 | McLeod | 232/35 |
| 3,747,839 | 7/1973 | Morton | 232/35 |

*Primary Examiner*—Francis K. Zugel
*Attorney, Agent, or Firm*—Robert K. Rhea

[57] ABSTRACT

An elongated rod, having a signal flag on one end thereof, is secured by its other end to a housing adapted to be rotatably secured to the side of a rural mailbox adjacent its entrance end, the mailbox having a vertically swinging hinged door for opening and closing the entrance. The housing is provided with a radially extending latch arm releaseably engageable with a cam secured to the adjacent side edge of the door. The housing contains a coil spring for rotating the housing from a horizontally disposed position of the rod, when in a first cocked position, to an upstanding signaling second position, when the door is opened.

2 Claims, 7 Drawing Figures

RURAL MAILBOX DELIVERY SIGNAL

BACKGROUND OF THE INVENTION

1. Field of the Invention

The present invention relates to rural mailboxes and more particularly to a visual signal automatically released to signaling position when the mailbox door is opened thus indicating that mail has been placed therein.

Rural mailboxes are usually located adjacent a road or highway at a considerable distance from the dwelling of the mail recipient. Conventional rural mailboxes are provided with a normally horizontally disposed signal flag element intended to be vertically disposed by the postman when mail has been deposited therein, however, the postman frequently neglects to actuate the signal flag. It is, therefore, desirable that an automatic signal be provided for actuating the signal flag when mail is deposited.

2. Description of the Prior Art

Mailbox signal flags automatically actuated to indicate mail delivery are shown by the prior art but have not come into general use, possibly for the reason that some of these signal devices comprise relatively complicated mechanisms, such as shown by U.S. Pat. Nos. 2,551,915; 3,291,386 and 3,498,255 which require more than a minimum of modification of the mailbox when mounting the apparatus on a conventional mailbox.

This invention is distinctive over these patents by providing a housing easily attached to a mailbox and supporting a signal flag with the housing being rotated between a first cocked position and a second signaling position by a spring contained by the housing. The housing is released from a cocked position to a signaling position by a latch released by the mailbox door being opened.

SUMMARY OF THE INVENTION

A dome-shaped housing, having a laterally projecting latch arm, is provided with a stub axle journalled for rotation about a horizontal axis by a housing base secured to one side of a mailbox adjacent its entrance door. A spring, surrounding the axle, has its respective ends disposed on opposing sides of a pair of parallel fingers secured respectively to the housing cover and housing base for normally disposing a signal flag in signaling position, the signal flag being secured to the dome-shaped housing. A latch pin or cam, secured to an adjacent side edge of the mailbox door, maintains the latch arm in a cocked position with the signal flag lowered until released by opening the mailbox door.

The principal objects of this invention are to provide an easily mounted mailbox signal automatically operated to signaling position when the mailbox door is opened which is relatively simple in construction and may be readily mass produced, easily connected with a conventional mailbox without modification thereof, and whose structural features will provide a relatively long useful life.

DESCRIPTION OF THE PREFERRED EMBODIMENT

Figure 1:
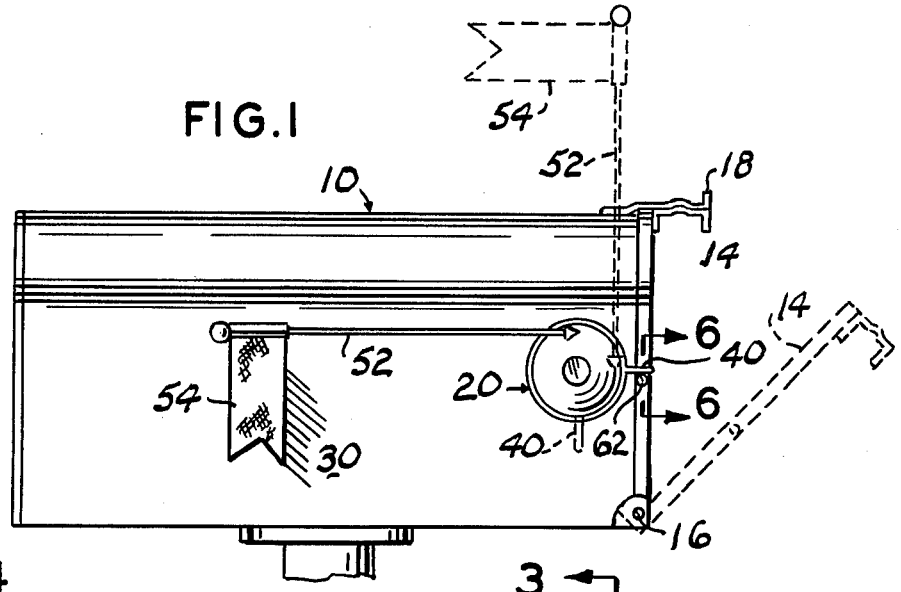
FIG. 1 is an elevational view of the device, when in cocked position and installed on the side of a rural mailbox and illustrating, by dotted lines, the mailbox door in opened position and the signal flag in signaling position.
Figure 3:
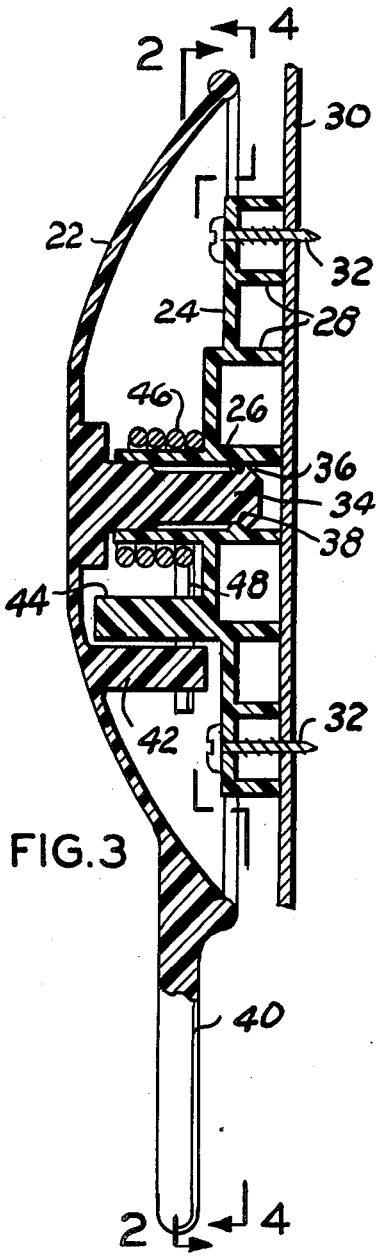
FIG. 3 is a vertical cross section view, to an enlarged scale, taken substantially along the line 3—3 of FIG. 2.
Figure 7:
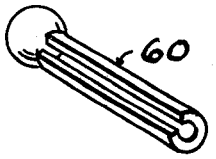
Figure 6:
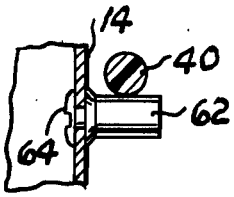
FIG. 6 is a vertical cross section view taken substantially along the line 6—6 of FIG. 1; and, FIG. 7 is a perspective view illustrating the signal flag connector clamp.

Like characters of reference designate like parts in those figures of the drawings in which they occur.

In the drawings:

The reference numeral 10 indicates a conventional rural mailbox mounted on a support 12. The entrance end of the mailbox is opened and closed by a door 14 swingably mounted at its depending end for vertical movement about a horizontal axis, indicated by a hinge pin 16. The mailbox and door is provided with a friction catch 18 normally maintaining the door in closed position.

The reference numeral 20 indicates the signal device, as a whole, comprising a dome-like housing when viewed in elevation. The device 20 includes a dome cover 22 and a base 24, preferably formed from lightweight material, such as plastic, and capable of being molded in the configuration illustrated. The base 24 is disk-like in general configuration having an axial hub 26 and a plurality of circular and/or transverse web portions 28 acting as sfiffeners. The base 24 is vertically secured to one side surface 30 of the mailbox 10 adjacent the door 14 by a plurality of self tapping metal screws 32. The diameter of the cover 22 is substantially greater than the diameter of the base 24 for concealing the base when connected therewith. The cover is coaxially provided with a stub axle 34 journalled by the hub 26. Intermediate its ends, the axle 34 is diametrically reduced to form an outstanding flange 36, at its end portion opposite the cover, for resiliently engaging a ring 38 integral with and projecting inwardly of the wall forming the bore of the hub thus locking the axle and cover in place. The cover is provided with a radially extending tongue or latch arm 40 projecting beyond the plane formed by the outer surface of the door 14 when in closed position and the latch arm is in signal cocked position for the reasons believed readily apparent.

Figure 2:
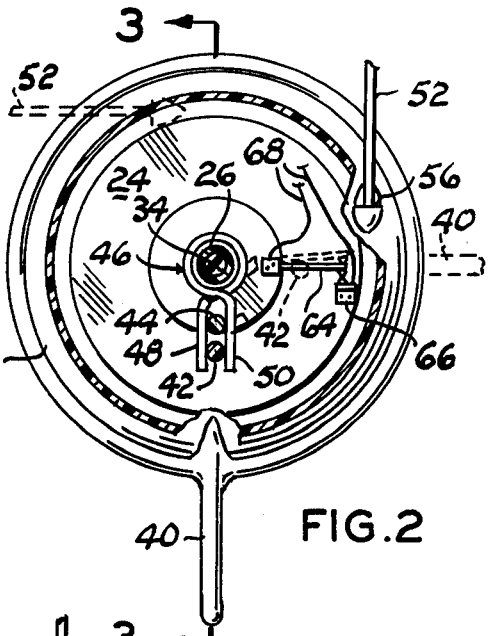
FIG. 2 is a vertical cross section view, to another scale, partially in elevation, taken substantially along the line 2—2 of FIG. 3.
Figure 4:
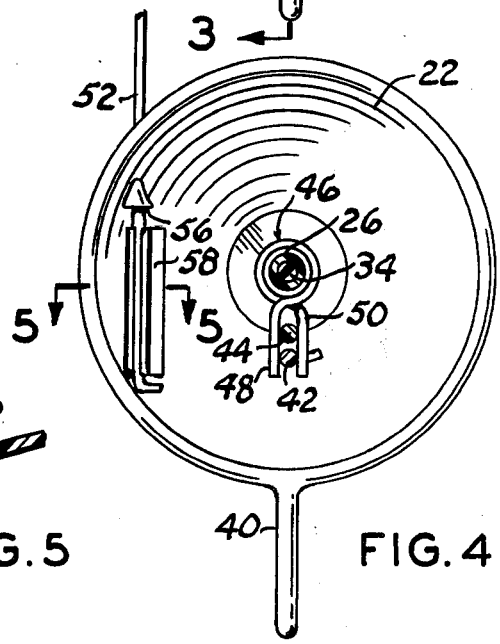
FIG. 4 is a vertical cross section view, to a smaller scale, partially in elevation, taken substantially along the line 4—4 of FIG. 3.

The concave surface of the cover is further provided with a rigid spring engaging finger 42 projecting toward the base 24 parallel with the axle 34 and disposed between the axle and the position of the latch arm 40. The base 24 is similarly provided with a rigid spring engaging finger 44 projecting toward the concave surface of the cover parallel with its hub 26 and disposed between its hub and the cover finger 42 when the cover is in latch released signal elevated position (FIGS. 2 and 4).

A spring 46 is helically wound intermediate its ends and surrounds the hub 26. The respective straight end portions 48 and 50 of the spring are disposed in crossed relation and extend in parallel spaced relation normal to the axis of its helical portion, on respective diametrically opposite sides of the fingers 42 and 44. This permits the cover 22 to be manually rotated angularly about the horizontal axis of its axle 34 in a counterclockwise direction, as viewed in FIG. 2, through an angle of at least 90° to its dotted line position and latching the cover in this position wherein the cover finger 42 moves the spring end portion 50 to a counterclockwise direction in a winding up action of the helical portion of the spring.

Figure 5:
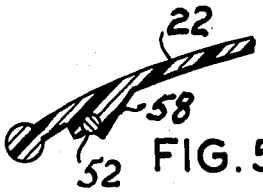
FIG. 5 is a fragmentary horizontal cross section view, to an enlarged scale, taken substantially along the line 5—5 of FIG. 4.

A signal rod 52, having a signal flag 54 secured to one of its ends, extends, at its other end portion, through an aperture 56 formed in the cover 22 and is supported by a friction clamp member 58 integral with the concave surface of the cover 22 (FIG. 5) and having a longitudinal axis extending parallel with the longitudinal axis of the latch arm 40. The signal flag 54, preferably formed from lightweight bright colored fabric material, is preferably connected with the end of the rod 52 opposite the cover 22 by an elongated rod-like split wall friction clamp member 60 capable of partially surrounding the rod 52 and one end portion of the flag when partially wrapped around the rod.

A latch pin forms a cam 62 secured by a screw 64 to an intermediate portion of the vertical side edge of the door 14 in position for supporting the latch arm 40 when the cover 22 is disposed in its solid line position of FIG. 1.

Operation

Assuming the signal device has been installed on the mailbox 10 and is disposed in its dotted line position of FIG. 1. With the door 14 in opened position, the housing cover 22 is manually rotated in a counterclockwise direction through an angle of at least 90°, as viewed in FIGS. 1 and 2, and the door closed so that the cam 62 supports the latch arm 40 in its first, signal flag lowered latched position. This disposes the rod 52 and flag 54 in its solid line position of FIG. 1. When the door 14 is opened, the cam 62 releases the latch arm and the tension of the spring 46 rotates the cover 22 in a clockwise direction, as viewed in FIGS. 1 and 2, to dispose the signal flag in its dotted line, signal elevated, second position of FIG. 1, the clockwise rotation being interrupted by the spring end portion 50 contacting the base finger 44, as illustrated in FIGS. 2 and 4.

Switch means, comprising a pair of normally closed contacts 64 and 66, may be secured to the base 24, in the position illustrated by FIG. 2, and connected by wires 68 with a circuit including an audible or visual signal, not shown, for energizing the latter when the door 14 is opened. The normally closed contacts being opened when the signal device is in cocked position by the cover finger 42 lifting the contact 64 to its dotted line position to interrupt the circuit.

Obviously the invention is susceptible to changes or alterations without defeating its practicability. Therefore, I do not wish to be confined to the preferred embodiment shown in the drawings and described herein.

I claim:

1. A door controlled signal device for a rural mailbox having a side wall and having an entrance opened and closed by a door hingedly mounted for vertical swinging movement, comprising:

a base flatly connected with the outer surface of said side wall at its end portion adjacent the entrance, said base having a horizontally disposed hub;

a dome-shaped cover overlying said base, said cover having a stub axle journalled by said hub for rotation of said cover with respect to said base;

a latch arm radially secured to the periphery of said cover;

a cover finger secured to the concave surface of said cover between said stub axle and said latch arm and projecting toward said base in parallel relation with respect to said stub axle;

a base finger secured to said base and projecting toward said cover in parallel spaced relation between said hub and said cover finger;

a signal flag supporting rod secured to and projecting beyond said cover with its axis disposed in off-set parallel relation with respect to the axis of said latch arm;

cam means including a pin secured to said door and underlying said latch arm for maintaining said cover in a first signal idle position; and, a spring means surrounding said hub and having parallel end portions disposed on respective diametrically opposite sides of said cover finger and said base finger for biasing said cover toward a second signal activated position.

2. The signal device according to claim 1 and further including:

a pair of normally closed electrical contacts opened by said cover finger when said cover is in said first position.

* * * * *